US006354360B1

(12) United States Patent
Betz et al.

(10) Patent No.: US 6,354,360 B1
(45) Date of Patent: Mar. 12, 2002

(54) DEVICE FOR DIRECTIONAL SOLIDIFICATION OF A FUSED METAL WHICH HAS BEEN POURED INTO A MOULDING SHELL AND A PROCESS FOR THIS PURPOSE

(76) Inventors: Ulrich Betz, Jahnstr. 12, D-63594 Hasselroth 2; Michael Schäfer, Dahlienstr. 10, D-6451 Kelsterbach; Franz Hugo, Sonnenstr. 24, D-63743 Aschaffenburg; Wilfried Schneiders, Düsterstr. 50, D-44797 Bochum; Jörn Grossman, Am Gehege 23, D-45525 Hattingen; Jürgen Preuhs, Rolandstr. 153, D-46047 Oberhausen, all of (DE)

( * ) Notice: Subject to any disclaimer, the term of this patent is extended or adjusted under 35 U.S.C. 154(b) by 0 days.

(21) Appl. No.: 09/399,177

(22) Filed: Sep. 20, 1999

(30) Foreign Application Priority Data

Sep. 22, 1998 (DE) ..... 198 43 354

(51) Int. Cl.[7] ..... B22D 7/10; B22D 27/00; B22D 27/04

(52) U.S. Cl. ..... 164/122.1; 164/338.1

(58) Field of Search ..... 164/499, 122, 164/122.1, 122.2, 493, 338.1; 373/139, 146

(56) References Cited

U.S. PATENT DOCUMENTS 1,595,970 A * 8/1926 Weed ..... 373/146
3,763,926 A * 10/1973 Tschinkel et al. ..... 164/338

* cited by examiner

*Primary Examiner*—M. Alexandria Elve
*Assistant Examiner*—Kevin McHenry
(74) *Attorney, Agent, or Firm*—Smith, Gambrell & Russell, LLP

(57) ABSTRACT

A device for directional solidification of a fused metal, for example a CoCrAlY alloy, which has been poured into a molding shell, by moving the molding shell out of a heating chamber and by immersing the molding shell in a liquid-metal bath serving as a cooling melt with a lower melting-point than the fused metal in the molding shell, for example tin. The liquid-metal bath is enclosed by several current carrying toroidal coils arranged coaxially relative to one another. For the purpose of orienting the stream filament of the agitated fused metal one or more guide plates are arranged in the space between the lateral circumferential surface of the molding shell and the inner wall of the shell containing the liquid-metal bath which is located opposite the molding shell.

5 Claims, 1 Drawing Sheet

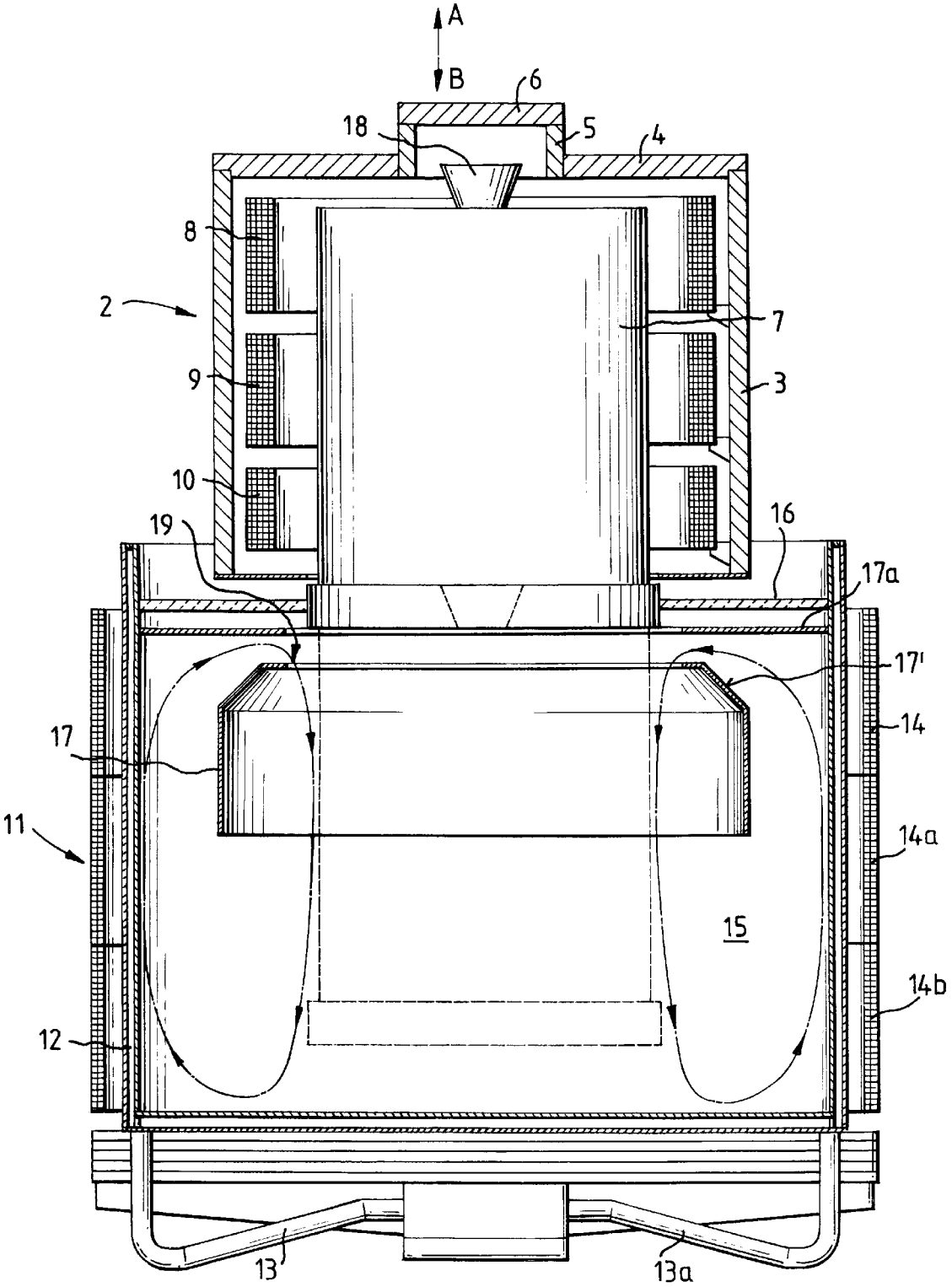
A
B
6
18
5
4
8
2
7
9
3
10
16
19
17a
17'
14
17
11
14a
15
14b
12
13
13a

DEVICE FOR DIRECTIONAL SOLIDIFICATION OF A FUSED METAL WHICH HAS BEEN POURED INTO A MOULDING SHELL AND A PROCESS FOR THIS PURPOSE

The present invention relates to a device for directional solidification of a fused metal which has been poured into a molding shell. The invention also relates to a process for accomplishing this.

A device for directional solidification of melts in a molding shell is known (DE 42 42 852) which exhibits variable cross-sections over its length and is capable of being moved relative to a heat source, whereby a heat insulation block which comprises an opening for passing the molding shell through it is arranged between the heat source and a heat sink, whereby the molding shell comprises external ribs which are arranged orthogonally relative to the direction of motion and which surround the molding shell positively and are adapted in their outer contour to the opening in the heat-insulation block.

However, this device is not suitable for the production of comparatively thin-walled castings from high-melting metal alloys, so-called superalloys. In addition, the device has to be precisely adapted to the configuration of each casting, for which reason the use of such devices is extraordinarily costly.

In addition, a process is known for the production of a metallic cast body in accordance with the precision casting process (DE 42 16 870), in particular of a cast body made of aluminum or of an alloy containing aluminum, by pouring a melt of the metal into a casting mould made of ceramic with porous walls and by cooling and solidifying the melt by using a coolant, whereby a cooling liquid which gradually penetrates the wall of the casting mould is employed by way of coolant. The boiling-temperature of the coolant is lower than the pour-in temperature of the melt and in which the casting mould is steadily immersed, starting from one end, in such a way that the solidification front forming by way of interface between melt and already solidified metal and the region of penetration in which the wall of the casting mould is penetrated by the cooling liquid across its thickness move substantially in the direction of the open surface of the melt. The speed of immersion of the casting mould in the cooling liquid, the thickness and the porosity of the wall of the casting mould, as well as the viscosity and the density of the cooling liquid are matched to one another in such a way that, viewed in the direction of motion of the solidification front, the region of penetration rapidly follows the solidification front.

This process is especially suitable for low-melting alloys, for example for an aluminum-silicon-magnesium alloy, in which case the cooling liquid is an emulsion consisting of wax and water and the casting mould is manufactured from porous ceramic.

A casting apparatus for directional solidification of molten metal is furthermore known (DOS 28 15 818) with a heating furnace that has an open end, through which a heated mould containing molten metal is lowered, with a liquid cooling bath arranged below the open end of the furnace, and with devices for gradual lowering of the heated mould out of the furnace through the open end and for immersion of said mould in the cooling bath. A heat-insulating dividing plate which is arranged between the open end of the furnace and the liquid cooling bath is constructed in such a way that its density is less than that of the liquid coolant, so that during the solidification process it floats on the surface of the bath, the dividing plate having at least one passage opening which is arranged in a line below the open end of the furnace in order to permit the lowering of the mould out of the furnace through the dividing plate and into the cooling bath. The dividing plate surrounds the mould when it is lowered in the direction towards the cooling bath in order to minimize heat losses from the mould until the mould is immersed. As a result of the minimization of the heat losses the heat gradient in the mould is substantially improved. In addition, the floating dividing plate reduces the evaporation of the liquid coolant during the lowering of the mould and creates a smooth bath surface for uniform cooling.

For this previously known casting apparatus a molten tin bath with a temperature of approximately 260° C. is utilized in order to achieve a particularly high heat gradient and a short casting cycle.

Furthermore, a device for directional solidification of a fused metal, for example nickel, which has been poured into a casting mould is known (DE 43 21 640), by moving the casting mould out of a heating chamber and by immersion of the casting mould in a liquid-metal bath serving as a cooling melt with a lower melting-point than the fused metal in the casting mould, for example aluminum. For the purpose of sealing between the heating chamber and the casting mould, a floating heat-insulation layer consisting of a flowable material is applied on the cooling melt and, before the casting mould penetrates the heat insulation layer and is immersed in the cooling melt, the heating chamber or the cooling melt is displaced so far that the heating chamber comes into contact with the heat insulation layer or is immersed in it.

Also known is a process for single-crystal growth (DOS 37 09 731), characterized by a cylindrical melting crucible, an annular heating device which is arranged coaxially with the central axis of the melting crucible on the outside of the melting crucible in order to melt an electrically conductive substance in the melting crucible, and a pair of electromagnetic windings which are arranged in contrary manner relative to one another, symmetrically in relation to the central axis of the melting crucible on the outside of the heating device, and which are arranged at substantially the same level on the axis of rotation of said melting crucible as the liquid surface of the substance which is melted in said melting crucible, with the effective average radius of the winding amounting to 1.5 to 5 times the radius of the melting crucible.

With this device the electromagnetic windings enclosing the melting crucible are intended to ensure that a magnetic flux substantially along the outer periphery and along the bottom of the melting crucible intersects the convection and the circulating flow substantially at right angles over a wide region of the melted material in order to suppress the flow of the melted material effectively.

Finally, a device is known (F. Hugo, H. Mayer, R. F. Singer: Directional and Single Crystal Solidification Using Liquid Metal Cooling, 42$^{nd}$ Technical Meeting ICI, Atlanta, September 1994; page 8, FIG. 9) for directional solidification of a fused metal which has been poured into a casting mould, by moving the casting mould out of a heating chamber and by immersion of the casting mould in a liquid-metal bath serving as a cooling melt. The metal bath is agitated by means of a mechanical stirrer in order to ensure that no pockets of heat which counteract directional solidification arise in the region of the outer surface of the casting mould. In practice, however, it has been shown that the stirring device cannot generate any uniform and controlled flows in the liquid-metal bath and furthermore is also liable to break down and has a relatively large space requirement.

An object of the present invention is to create a device with which the disadvantages of the known devices are avoided and with which it is ensured that the mechanical components within the liquid-metal bath give rise to no problems in the course of solidification and flow-melting as a consequence of thermal expansion.

The toroidal coils preferably operate in phase-offset manner corresponding to the energizing three-phase current.

Advantageously, two guide plates or groups of guide plates are provided which both have an annular configuration and which enclose, subject to a spacing, the molding shell immersed in the liquid-metal bath and jointly form an annular gap, through which the fused metal flows radially inwards towards the molding shell.

In the case of a process for directional solidification of a fused metal, for example a CoCrAlY alloy, which has been poured into a molding shell, by moving the molding shell out of a heating chamber and by immersing the molding shell in a liquid-metal bath serving as a cooling melt with a lower melting-point than the fused metal in the molding shell, for example tin, according to the invention the liquid-metal bath is exposed to magnetic fields generated by current-carrying conductor loops which wrap around the liquid-metal bath and which have the three-phase current energizing them applied to them in phase-offset manner.

SUMMARY OF THE INVENTION

The above and other objects of the present invention can be achieved by a device for directional solidification of a fused metal, for example CoCrAlY alloy, which has been poured into a molding shell, by moving the molding shell out of a heating chamber and by immersing the molding shell in a liquid-metal bath. This bath serves as a cooling melt with a lower melting-point than the fused metal in the molding shell, for example tin. The liquid-metal bath is enclosed by several current-carrying toroidal coils arranged coaxially relative to one another. For the purpose of orienting the stream filament of the agitated fused metal a plurality of guide plates are arranged in the space between the lateral circumferential surface of the molding shell and the inner wall of the shell containing the liquid-metal bath which is located opposite said molding shell.

A feature of the present invention also resides in a process for directional solidification of a fused metal, such as a CoCrAlY alloy, which has been poured into a molding shell, by moving the molding shell out of a heating chamber and by immersing the molding shell in a liquid-metal bath serving as a cooling melt with a lower melting-point than the fused metal, for example tin.

The liquid-metal bath is exposed to magnetic fields generated by current-carrying toroidal loops which wrap around the liquid-metal bath and which have the three-phase current energizing them applied to them in phase-offset manner. A flow in the liquid bath which is generated by the magnetic fields of the toroidal coils is oriented with guide plates.

BRIEF DESCRIPTION OF DRAWINGS

The present invention will be further understood with reference to the drawings, wherein:

The FIGURE shows a schematic cross sectional view of an apparatus according to the invention.

DETAILED DESCRIPTION OF INVENTION

As described in greater detail in the appended drawing, which shows the device of the present invention as a longitudinal section through a mould-heater, there is a liquid-metal container arranged below the mould-heater with three induction coils encompassing said liquid-metal container.

The device comprises a mould-heater 2 in the form of a hollow cylindrical casing 3 with an upper part 4 in the form of a circular disc with collar 5 and cover 6 and with three heating elements 8, 9, 10 retained in the casing 3 and enclosing a molding shell 7. A liquid-metal bath 11 is arranged below the mould-heater 2 with a double-walled trough 12. The cooling/heating-liquid inlet/outlet 13, 13*a,* with three induction coils 14, 14*a,* 14*b* enclosing the trough 12. A heat-insulation layer 16 covers the cooling-metal melt 15 in the upward direction, floating on the latter and consisting of a free-flowing and pourable material and with a collar-shaped guide plate 17.

For the sake of better clarity of layout the units and components surrounding the device and generating the energy of the melt are not represented in any detail in the drawing. For instance, the heating elements 8, 9, 10 and the induction coils 14, 14*a*, 14*b* are connected to current supplies. The molding shell 7 is borne by a holding device which permits the lowering and raising of the casting mould 7 in the arrow direction A-B. The illustrated device part is located as a whole in a vacuum chamber, so that the pouring of the high-melting metal alloy into the molding shell 7 and the solidification process can take place subject to exclusion of oxygen.

After the high-melting metal alloy has been poured into the molding shell 7 via the feeder 18 the molding shell is lowered in the arrow direction B until it has reached the final position drawn in with dashed lines and has the cooling melt 15 flowing almost totally around it. At the same time the three induction coils 14, 14*a,* 14*b* have a (3-phase) alternating current (eg, 50–300 V, 100–150 kW) flowing through them, with the effect that a flow arises in the cooling-metal melt (eg, a tin melt), the stream filament of which approximately follows the course drawn in with dot-dashed lines. This course of flow of the cooling metal melt is assisted by the guide plates 17, 17*a,* which both together form a kind of nozzle 19 and force the flow path to flow along the outer surface of the molding shell 7—to be specific, vertically downwards. The heat insulation layer 16 in the case represented is formed by a layer of granular material which floats on the cooling metal melt 15 and prevents an excessive loss of heat in the region of the surface of the melt.

The two guide plates 17, 17*a* both have an annular configuration, the upper guide plate 17*a* having approximately the shape of a circular ring and the lower guide plate 17 being formed substantially in the manner of a circular cylinder and provided with a collar or flange part 17' oriented in the radial direction.

Further variations and modifications of the foregoing will be apparent to those skilled in the art and are intended to be encompassed by the claims appended hereto.

German priority application 198 43 354.9 filed Sep. 22, 1998 is relied on and incorporated herein by reference.

We claim:

1. A device for directional solidification of a fused metal, comprising a moulding shell, movable with respect to a heating chamber, said moulding shell being immersible in a liquid-metal bath, a plurality of current-carrying toroidal coils arranged coaxially relative to one another for enclosing a liquid-metal bath, wherein for the purpose of orienting a stream filament of an agitated fused metal a plurality of guide plates are arranged in a space between a lateral circumferential surface of the moulding shell and an inner wall of a housing for containing a liquid-metal bath which is located opposite said moulding shell.

2. The device according to claim 1 wherein two guide plates or groups of guide plates are provided which both have an annular configuration and which enclose, subject to a spacing, the moulding shell when said shell is immersed in a liquid metal bath and which jointly form an annular gap, through which fused metal can flow radially inwards towards the moulding shell.

3. A process for the directional solidification of a fused metal, comprising pouring said metal into a moulding shell, by moving the moulding shell out of a heating chamber and by immersing the moulding shell in a liquid-metal bath serving as a cooling melt with a lower melting-point than the fused metal, exposing the liquid-metal bath to magnetic field generated by current-carrying toroidal loops which wrap around the liquid-metal bath and which have the three-phase current energizing them in phase-offset manner and orienting flow in the liquid bath which is generated by the magnetic fields of the toroidal coils with guide plates.

4. The process according to claim 3 wherein said fused metal is CoCrAlY alloy.

5. The process according to claim 3 wherein the liquid-metal bath contains tin.

* * * * *